US007380523B2

(12) United States Patent
Donnelly

(10) Patent No.: US 7,380,523 B2
(45) Date of Patent: Jun. 3, 2008

(54) CONTROL FOR A FUEL-FIRED WATER HEATING APPLIANCE HAVING VARIABLE HEATING RATES

(75) Inventor: Donald E. Donnelly, St. Louis, MO (US)

(73) Assignee: Emerson Electric Co., St. Louis, MO (US)

( * ) Notice: Subject to any disclaimer, the term of this patent is extended or adjusted under 35 U.S.C. 154(b) by 133 days.

(21) Appl. No.: 11/485,006

(22) Filed: Jul. 12, 2006

(65) Prior Publication Data

US 2008/0011245 A1 Jan. 17, 2008

(51) Int. Cl.
*F22B 5/04* (2006.01)

(52) U.S. Cl. ..... 122/14.31

(58) Field of Classification Search ..... 122/14.31, 122/14, 3, 14.22, 14.2, 14.21
See application file for complete search history.

(56) References Cited

U.S. PATENT DOCUMENTS 4,184,457 A * 1/1980 Trotter et al. ..... 122/448.1
4,700,886 A 10/1987 McGhee et al. ..... 236/25
4,852,524 A * 8/1989 Cohen ..... 122/448.1
4,922,861 A * 5/1990 Tsutsui et al. ..... 122/448.1
2004/0173600 A1 9/2004 Munsterhuis et al. ..... 219/494

* cited by examiner

*Primary Examiner*—Gregory A Wilson
(74) *Attorney, Agent, or Firm*—Harness, Dickey & Pierce, P.L.C.

(57) ABSTRACT

A control system for a fuel-fired water heater appliance is provided that includes a control for the appliance that is in communicating with a sensor for sensing a water flow rate through the water heater. The control system is capable of controlling a gas valve to supply fuel to a burner at a maximum rate of fuel flow when the water flow rate is determined to be above a predetermined threshold. The control system is capable of controlling the gas valve to supply fuel to a burner at a reduced rate of fuel flow when the water flow rate is below a predetermined threshold, whereby the control 128 establishes the lower rate of heating operation as long as the temperature of the heated water is below the predetermined maximum temperature.

15 Claims, 2 Drawing Sheets

CONTROL FOR A FUEL-FIRED WATER HEATING APPLIANCE HAVING VARIABLE HEATING RATES

FIELD

The present disclosure relates to fuel fired water heating appliances, and more particularly to the improved control of fuel-fired water heating appliances.

BACKGROUND

The statements in this section merely provide background information related to the present disclosure and may not constitute prior art.

Gas water heater appliances typically utilize a temperature sensor for sensing when the water in the appliance drops below a minimum desired temperature, at which point the water heater appliance turns on a gas valve to supply fuel to a burner for heating the water. Burner operation is continued until the temperature of the water being heated rises to a predetermined maximum temperature, at which point the water heater appliance turns off the gas valve. Accordingly, the typical water heater appliance only provides heating to maintain an available supply of heated water at a temperature that is between a predetermined maximum temperature and a minimum desired temperature. This can result in a less than desirable hot water temperature when hot water is drawn for use in showers, for example.

SUMMARY

In one aspect of the present invention, various embodiments of a control system for a fuel-fired water heater appliance are provided. In at least one embodiment, the control for the appliance is in communication with a sensor for determining when the water flow rate through the water heater exceeds a predetermined threshold. The control system is capable of controlling a gas valve to supply fuel to a burner at a maximum rate of fuel flow when the water flow rate is determined to be above a predetermined threshold. The maximum rate of fuel flow is established when the water flow rate is above a predetermined threshold, and the sensed water temperature is below a predetermined maximum temperature but above the minimum desired temperature at which the gas valve is normally turned on.

In another aspect, a control for controlling the operation of a fuel fired water heating appliance is provided. The control includes a flow sensor capable of monitoring the rate of water flow through the water heater and providing an output that is used to determine when the water flow rate is above a predetermined threshold. The control further includes a temperature sensor capable of providing an output indicative of the temperature of the water in the appliance. A gas valve capable of controlling the supply of fuel to the burner at a maximum rate of fuel flow and at least one reduced rate of fuel flow is employed by the appliance. A controller or processor in communication with the flow sensor, the temperature sensor, and the gas valve is configured to control the gas valve to establish a maximum rate of fuel flow to the burner in response to receiving an output from the temperature sensor indicative of a heated water temperature that is below a maximum predetermined value when the water flow rate is above the predetermined threshold. The controller may also be configured to control the gas valve to establish at least one reduced rate of fuel flow to the burner in response to receiving an output from the temperature sensor indicative of a heated water temperature that is below a maximum predetermined value when the water flow rate is below the predetermined threshold.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Corresponding reference numerals indicate like or corresponding parts and features throughout the drawings.

DETAILED DESCRIPTION

The following description is merely exemplary in nature and is not intended to limit the present disclosure, application, or uses.

In one aspect of the present invention, various embodiments of a controller and control system for a fuel-fired water heating appliance are provided that establish maximum heating operation when the rate of water draw exceeds a predetermined threshold, and the sensed water temperature is below a predetermined maximum temperature but above a minimum desired temperature at which the gas valve is normally turned on. The control may further establish a minimum rate of heating operation when the rate of water draw is below the predetermined threshold, and the temperature of the heated water in the appliance falls below a minimum desired temperature.

Figure 1:
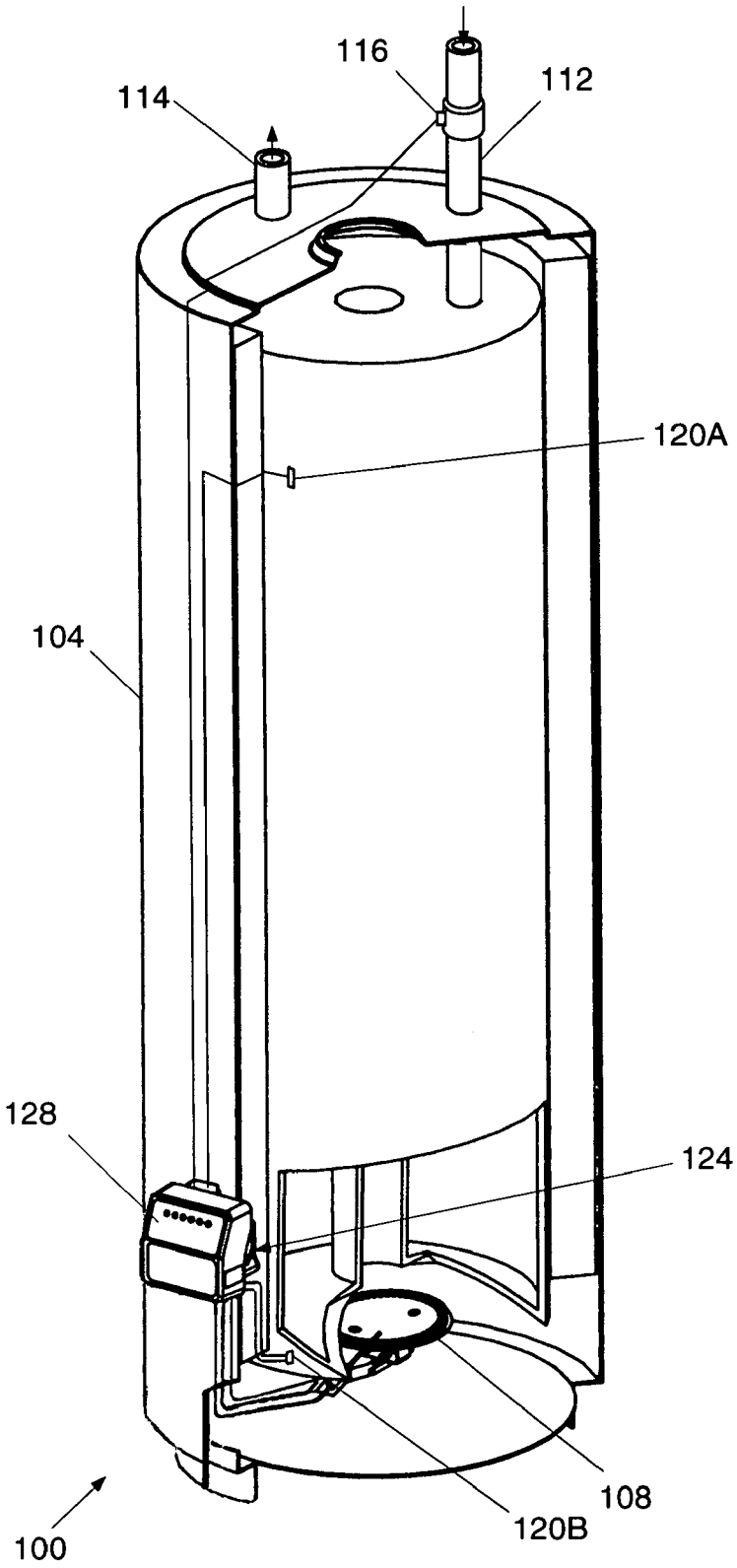
FIG. 1 shows one embodiment of a control system in a cut-away view of a water heater according to the principles of the present invention.
Figure 2:
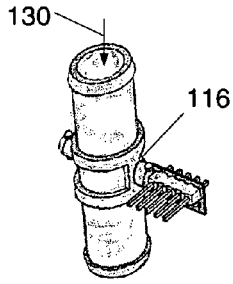
FIG. 2 is an exemplary flow sensor of the control system embodiment shown in FIG. 1.

One embodiment of a fuel-fired water heating appliance having such a control system is shown in FIG. 1. The fuel-fired water heating appliance 104 generally includes a water storage tank and a burner 108 located beneath the storage tank. The water heating appliance 104 also includes a cold water supply pipe 112 leading to the storage tank, and a hot water exit pipe 114 leading from the top of the appliance. One or more temperature sensors 120A and 120B may be employed for sensing the temperature of the water in the water heating appliance 104. For example, the lower sensor 120B may sense the temperature of the water in the bottom of the appliance near the outlet of the cold water supply tube/dip tube 112, which would enable sensing flow of incoming cold water corresponding to draw of hot water exiting through pipe 114. Alternatively, the upper sensor 120A may sense the temperature of the heated water at the top of the tank that is being drawn on demand from the water heating appliance 104. A control 128 controls the activation of a gas valve 124 for supplying fuel flow to the burner to establish heating operation, in response to the one or more sensors sensing a water temperature that is below a desired minimum temperature (at which the gas valve is normally turned on).

Gas water heater appliances typically utilize a temperature sensing device for sensing when the temperature of the water in the appliance drops below a minimum desired temperature, such as 120 degrees Fahrenheit for example, at which point the water heater appliance 104 turns on a gas valve 124 to supply fuel to a burner 108 for heating the water. The gas valve 124 remains on to continue operation of the burner 108 until the temperature of the water being heated rises to a predetermined maximum temperature, such as 135 degrees Fahrenheit for example. At this point, the water heater appliance 104 turns off the gas valve 124. However, in some circumstances the temperature of the heated water may be between the minimum desired temperature and maximum temperature (at 130 degrees for example) when hot water is drawn, such as in the morning when showers are typically taken. In such situations, a substantial amount of time may transpire, during which hot water is drawn and cold water is introduced into the heater, before the water temperature drops below the desired temperature of 120 degrees Fahrenheit to cause the gas valve 124 to turn on and initiate heating operation. This results in a less than desirable temperature in the hot water available for showers, especially where successive showers are taken by many family members in the morning.

In the various embodiments, a control system 100 is provided that initiates heating operation when the water temperature falls below a minimum desired temperature (similar to that of a typical gas water heater), and also where hot water draw from the water heater exceeds a predetermined threshold (such as during a shower). For example, if the temperature of the heated water in a water heater appliance 104 was at approximately 130 degrees Fahrenheit and the predetermined maximum temperature was 135 degrees, the typical manner of operation would not activate heating until the water temperature dropped below a minimum desired temperature, such as 120 degrees as an example. In the various embodiments, the operation of the fuel fired water heater would activate heating when the rate of hot water draw is determined to be above a predetermined threshold rate, and the temperature of the heated water is below the predetermined maximum temperature. Thus, in the above example, a shower would exceed the predetermined threshold rate of draw of heated water, and the water temperature of 130 degrees would be below the 135 degree predetermined maximum, so heating operation would be initiated immediately rather than waiting for a significant amount of hot water draw to lower the temperature below the 120 degree activation point.

In the first embodiment, the control system includes a controller 128, and a flow sensor 116 in communication with the controller 128 for determining when the rate of water draw is above a predetermined threshold. It should be noted that the flow sensor is shown at the cold water supply inlet pipe 112, but may alternatively be located on the hot water exit pipe 114 as the water entering the tank is equivalent to the water exiting the tank. The fuel-fired water heater control 128 is in communicating with the sensor 116 for sensing a water flow rate through the water heater 104. The control 128 is capable of controlling a gas valve 124 to supply fuel to a burner 108 at a maximum rate of fuel flow when the draw or water flow rate is determined to be above a predetermined threshold, rather than waiting for a significant amount of hot water draw and cold water infusion to lower the sensed water temperature below the minimum desired temperature. The controller controls the gas valve 124 to supply fuel to the burner when the draw or water flow rate is determined to be above a predetermined threshold, and the sensed water temperature is below a predetermined maximum temperature but above the minimum desired temperature at which the gas valve is normally turned on (regardless of water flow rate).

The gas valve 124 may further be configured to provide more than one rate of heating operation, and may include a first maximum rate of fuel flow and at least a second reduced rate of fuel flow. The maximum rate of fuel flow would provide a maximum heating rate that would be used when the water draw or flow rate is determined to be above the predetermined threshold. The control 128 is capable of controlling the gas valve 124 to supply fuel to a burner 108 at a reduced rate of fuel flow when the water flow rate is below a predetermined threshold, whereby the control 128 establishes the lower rate of heating operation as long as the temperature of the heated water is below the predetermined maximum temperature. Such a predetermined maximum temperature may be approximately 135 degrees Fahrenheit, for minimizing the risk of excessively high temperature or scalding situations.

In the first embodiment, the flow sensor 116 may be connected to the cold water supply pipe 112 to monitor the flow rate of water being supplied to the water heater, but alternatively may be connected to the hot water outlet pipe 114. The sensor 116 for sensing water flow is capable of monitoring the water flow rate through the water heater appliance 104 and providing an output that is used to determine when the water flow rate through the water heater appliance 104 is above a predetermined threshold rate. The flow sensor 116 may provide an analog output that varies with the rate of water flow through the water heater 104, such as a resistance or voltage output that varies as the flow rate changes. Alternatively, the flow sensor may comprise a switching device that switches when the flow rate of water through the water heater exceeds a predetermined threshold. In one embodiment, the predetermined threshold is a rate of at least 3.0 gallons per hour, which is indicative of, or exemplary of a draw rate corresponding to a typical shower usage. This flow sensor 116 for determining when the water draw rate is above 3 gallons per hour is distinguished from monitoring the water temperature sensor 120B near the outlet of the cold water supply/dip tube 112 to sense cold water flow into the tank, because the flow sensor 116 is capable of differentiating between intermittent water draw that may introduce cold water near sensor 120B, and continuous water draw such as a shower. The control is configured to continuously monitor the sensor 116 to determine when and how long the water draw rate is above the predetermined threshold. Accordingly, the control is capable of controlling the gas valve to supply fuel to the burner at a maximum rate of fuel flow when the water flow rate is above a predetermined threshold for more than a given time, and to supply fuel to the burner at a reduced rate of fuel flow when the water flow rate falls below the predetermined threshold and the sensed water temperature is below the predetermined maximum.

The control system 100 for the fuel-fired water heater further comprises at least one temperature sensor 120B capable of providing an output indicative of the temperature of the heated water within the water heater. The temperature sensor 120B, and optionally sensor 120A, are in communication with the controller 128, such that the output of the temperature sensor may be monitored by the controller 128. The temperature sensor 120B may be a thermistor having a resistance that changes in value as the temperature of the heated water changes, and the thermistor may be mounted to a surface external to the water storage tank as shown in FIG. 1. Alternatively, the temperature sensor 120B may be a thermal switch device that switches when the temperature of the heated water exceeds the predetermined maximum temperature. The controller 128 controls the gas valve 124 to supply fuel to the burner 108 only when the sensed temperature of the heated water is less than a predetermined maximum temperature (such as 135 degrees Fahrenheit, for example), and the control shuts off the gas valve when the output of the temperature sensor 120B (and optionally sensor 120A) is indicative of a water temperature above the predetermined maximum. In the first embodiment, the predetermined maximum temperature is at least 135 degrees Fahrenheit.

Figure 3:
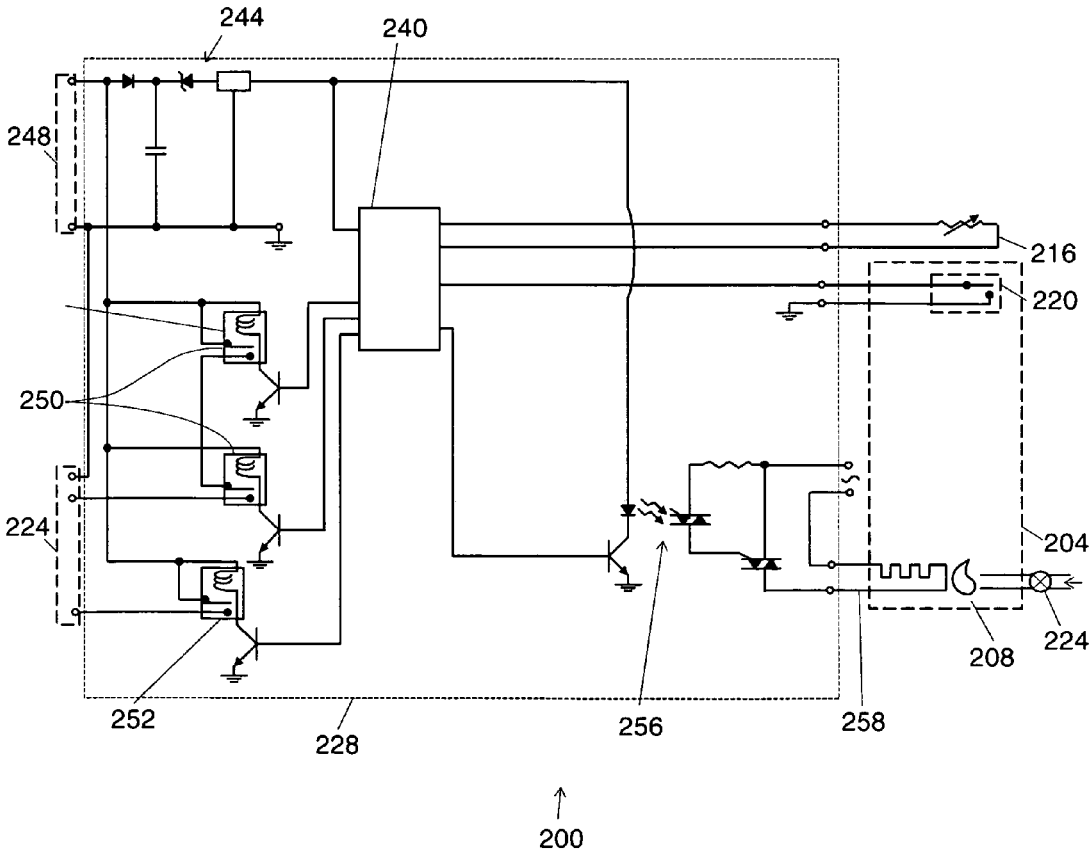
FIG. 3 is a schematic diagram of a second embodiment of a control for a fuel-fired water heating appliance according to the principles of the present invention.

In a second embodiment shown as a schematic in FIG. 3, a control system 200 for controlling the operation of a fuel fired water heating appliance 204 having a burner 208 is provided. The control system 200 comprises a flow sensor 216 capable of monitoring the rate of water flow through the water heater 204 and providing an output that is used to determine when the water flow rate is above a predetermined threshold. The control system 200 further comprises a temperature sensor 220 capable of providing an output indicative of the temperature of the heated water 204. A controller 228 is in communication with the flow sensor 216, the temperature sensor 220, and a gas valve 224. The controller 228 is configured to control the gas valve 224 to establish a maximum rate of fuel flow to the burner 208 in response to receiving an output from the temperature sensor 220 indicating the heated water temperature is below a maximum predetermined value when the water flow rate is above the predetermined threshold, rather than waiting for a significant amount of hot water draw and cold water infusion to lower the sensed water temperature below the minimum desired temperature. The gas valve 224 is capable of controlling the supply of fuel to the burner 208 at a maximum rate of fuel flow and at least one reduced rate of fuel flow is also included. The controller 228 is also configured to control the gas valve 224 to establish at least one reduced rate of fuel flow to the burner 208 in response to receiving an output from the temperature sensor 220 indicating the heated water temperature is below a maximum predetermined value when the water flow rate is below the predetermined threshold.

The controller may include a microprocessor 240 that is in communication with at least one temperature sensor 220 for sensing the temperature of the water being heated, and is also in communication with the flow sensor 216. The microprocessor 240 is configured to control the activation of the gas valve 224 in either a maximum rate of fuel flow, and at least one reduced rate of fuel flow. The microprocessor 240 is configured to continuously monitor the sensor 216 to determine when the water draw rate is above the predetermined threshold, and how long the water draw rate remains above the predetermined threshold. The predetermined threshold may be, for example, a rate of at least 3.0 gallons per hour, which is indicative of a water draw rate corresponding to a typical shower usage. Accordingly, the control 228 is capable of controlling the gas valve 224 to supply fuel to the burner 208 at a maximum rate of fuel flow when the water flow rate is above a predetermined threshold for more than a given time, and to supply fuel to the burner 208 at a reduced rate of fuel flow when the water flow rate falls below the predetermined threshold and the sensed water temperature remains below the predetermined maximum temperature.

Referring to FIG. 3, the control 228 includes a microprocessor 240 in connection with a power supply 244 that is supplied by an external low voltage power source 248. The microprocessor 240 is in connection with a flow sensor 216 and a temperature sensor 220 for sensing the temperature of the water in the water heater appliance 204. The microprocessor 240 is configured to control a series of relays 250 to actuate a gas valve 224 to establish a maximum fuel flow rate, and to control a relay 252 to establish a reduced fuel flow rate in the gas valve 224. The microprocessor 240 may further be configured to control a switching means 256 to switch line voltage to a hot surface igniter 258 for igniting gas at the burner 208. The microprocessor 240 is accordingly configured to monitor the water temperature via temperature sensor 220, and to continuously monitor the flow sensor 216 to determine when the water draw rate is above the predetermined threshold for more than a minimum time period, and to responsively control the gas valve 224 to supply fuel to the burner 208 at a maximum rate of fuel flow as long as the flow rate is above a predetermined threshold and the water temperature is below a predetermined maximum temperature. The microprocessor 240 is further configured to control the gas valve 224 to supply fuel to the burner 208 at a reduced rate of fuel flow as long as the flow rate is below the predetermined threshold and the water temperature is below the predetermined maximum temperature.

What is claimed is:

1. A fuel-fired water heater control in communication with a water temperature sensor, and flow sensor capable of monitoring the water flow rate through the water heater and providing an output that is used to determine when the water flow rate through the water heater is above a predetermined threshold rate, the control being capable of controlling a gas valve to supply fuel to a burner at a maximum rate of fuel flow when the water flow rate is above a predetermined threshold and the sensed water temperature is below a predetermined maximum temperature but above the minimum desired temperature at which the gas valve is normally turned on, wherein the sensor provides an analog output that varies with the rate of water flow through the water heater.

2. A fuel-fired water heater control in communication with a water temperature sensor, and flow sensor capable of monitoring the water flow rate through the water heater and providing an output that is used to determine when the water flow rate through the water heater is above a predetermined threshold rate, the control being capable of controlling a gas valve to supply fuel to a burner at a maximum rate of fuel flow when the water flow rate is above a predetermined threshold and the sensed water temperature is below a predetermined maximum temperature but above the minimum desired temperature at which the gas valve is normally turned on, wherein the sensor comprises a switching device that switches when the flow rate of water through the water heater exceeds a predetermined threshold.

3. A fuel-fired water heater control in communication with a water temperature sensor, and flow sensor capable of monitoring the water flow rate through the water heater and providing an output that is used to determine when the water flow rate through the water heater is above a predetermined threshold rate, the control being capable of controlling a gas valve to supply fuel to a burner at a maximum rate of fuel flow when the water flow rate is above a predetermined threshold and the sensed water temperature is below a predetermined maximum temperature but above the minimum desired temperature at which the gas valve is normally turned on, wherein the predetermined threshold is a rate of at least 3.0 gallons per hour.

4. A fuel-fired water heater control in communication with a water temperature sensor, and flow sensor for sensing a water flow rate through the water heater, the control being capable of controlling a gas valve to supply fuel to a burner at a maximum rate of fuel flow when the water flow rate is above a predetermined threshold and the sensed water temperature is below a predetermined maximum temperature but above the minimum desired temperature at which the gas valve is normally turned on, wherein the control is capable of controlling the gas valve to supply fuel to a burner at a reduced rate of fuel flow when the water flow rate is below a predetermined threshold and the sensed water temperature is above the desired minimum temperature, and wherein the control controls the gas valve to supply fuel to the burner only when the sensed temperature of the heated water is less than a predetermined maximum temperature.

5. The fuel-fired water heater control of claim 4 wherein the water temperature sensor is a thermal switch that switches when the temperature of the heated water exceeds the predetermined maximum temperature.

6. The fuel-fired water heater control of claim 4 wherein the predetermined maximum temperature is at least 135 degrees Fahrenheit.

7. A control system for controlling the operation of a fuel fired water heating appliance having a burner, the control system comprising:

a flow sensor capable of monitoring the rate of water flow through the water heater and providing an output that is used to determine when the water flow rate is above a predetermined threshold;

a temperature sensor capable of providing an output indicative of the temperature of the heated water;

a gas valve capable of controlling the supply of fuel to the burner at a maximum rate of fuel flow and at least one reduced rate of fuel flow; and a controller in communication with the flow sensor, the temperature sensor, and the gas valve, the controller being configured to control the gas valve to establish a maximum rate of fuel flow to the burner in response to receiving an output from the temperature sensor indicative of a heated water temperature that is below a maximum predetermined value when the water flow rate is above the predetermined threshold, and being configured to control the gas valve to establish at least one reduced rate of fuel flow to the burner in response to receiving an output from the temperature sensor when the water flow rate is below the predetermined threshold.

8. The control system of claim 7 wherein the flow sensor provides an analog output that varies with the rate of water flow through the water heater.

9. The control system of claim 7 wherein the sensor comprises a switching device that switches when the flow rate of water through the water heater exceeds a predetermined threshold.

10. The control system of claim 7 wherein the sensor monitors the flow rate of water being supplied to the water heater.

11. The control system of claim 10 wherein the predetermined threshold is a rate of at least 3.0 gallons per hour.

12. The control system of claim 7 wherein the temperature sensor is a thermistor having a resistance that changes in value as the temperature of the heated water changes.

13. The control system of claim 7 wherein the temperature sensor is a thermal switch that switches when the temperature of the heated water exceeds the predetermined maximum temperature.

14. The control system of claim 7 wherein the controller configured to control the gas valve to supply fuel to the burner at a maximum rate of fuel flow when the water flow rate is above a predetermined threshold for more than a minimum time period.

15. A control system for controlling the operation of a fuel fired water heating appliance having a burner, the control system comprising:

a flow sensor for monitoring the rate of water flow through the water heater and providing an output for determining when the water flow rate is above a predetermined threshold;

a temperature sensor for providing an output for determining when the temperature of the water being heated exceeds a predetermined maximum temperature;

a gas valve capable of supplying fuel to the burner at a maximum rate of fuel flow and at least one reduced rate of fuel flow; and a microprocessor in communication with the flow sensor, the temperature sensor, and the gas valve, the microprocessor being configured to control the gas valve to supply fuel to the burner at a maximum rate of fuel flow when the water flow rate is above a predetermined threshold for more than a minimum time period, and to supply fuel to the burner at a reduced rate of fuel flow when the water flow rate falls below the predetermined threshold and the sensed water temperature is below the predetermined maximum temperature.

* * * * *